US009878361B2

(12) United States Patent
Caporusso

(10) Patent No.: US 9,878,361 B2
(45) Date of Patent: Jan. 30, 2018

(54) DIE AND COUNTER-DIE TYPE BENDING MACHINE FOR RIGHT-HAND AND LEFT-HAND BENDING AN ELONGATED PIECE

(71) Applicant: CML INTERNATIONAL S.p.A., Piedimonte San Germano (IT)

(72) Inventor: Alessandro Caporusso, Piedimonte San Geramano (IT)

(73) Assignee: CML INTERNATIONAL S.P.A., Piedimonte San (IT)

( * ) Notice: Subject to any disclaimer, the term of this patent is extended or adjusted under 35 U.S.C. 154(b) by 0 days.

(21) Appl. No.: 14/267,047

(22) Filed: May 1, 2014

(65) Prior Publication Data

US 2014/0326033 A1 Nov. 6, 2014

(30) Foreign Application Priority Data

May 2, 2013 (IT) ..... RM2013A0259

(51) Int. Cl.
*B21D 7/04* (2006.01)
*B21D 7/024* (2006.01)

(52) U.S. Cl.
CPC ..... *B21D 7/04* (2013.01); *B21D 7/024* (2013.01)

(58) Field of Classification Search
CPC ..... B21D 37/02–37/14; B21D 7/02; B21D 7/022; B21D 7/024; B21D 7/04; B23Q 3/06; B23Q 2003/15586
USPC ..... 72/482.6, 369; 483/58
See application file for complete search history.

(56) References Cited

U.S. PATENT DOCUMENTS 1,919,839 A * 7/1933 Hilgers ..... B21D 9/073 72/158
2,171,907 A * 9/1939 Beehler ..... B21D 7/024 72/154
2,455,138 A 11/1948 Perkins
(Continued)

FOREIGN PATENT DOCUMENTS

EP 0 168 331 1/1986
EP 0445081 A3 9/1991
(Continued)

OTHER PUBLICATIONS

European Search Report, dated Apr. 23, 2014, from corresponding EP application.

*Primary Examiner* — James S McClellan
*Assistant Examiner* — Peter Iannuzzi
(74) *Attorney, Agent, or Firm* — Young & Thompson

(57) ABSTRACT

A die and counter-die type bending machine for right- and left-hand bending an elongated piece (P) has a roller-shaped die (1) provided with a partial circumferential groove (2) that is interrupted at its two ends, the die (1) being driven by the shaft (0) of a motor, and a pair of counter-dies (25, 26) being carried by respective counter-die support members (19, 20) pivoted on a turret (11) that is rotatable mounted on a slide (8) in a given arc of rotation about its axis perpendicular to the slide (8) by a lever (12). The die (1) has an elongated piece retaining element (3, 4) at each of two ends of its partial circumferential groove (2). The first or the second counter-die is selectable to co-operate with the die in bending the elongated piece depending on the required curvature to right hand or left hand.

3 Claims, 12 Drawing Sheets

(56) References Cited

U.S. PATENT DOCUMENTS

| | | | | | |
|---|---|---|---|---|---|
| 3,236,082 | A * | 2/1966 | Beck | B21D 7/022 | 228/17.5 |
| 3,448,602 | A * | 6/1969 | Stanley | B21D 7/063 | 72/149 |
| 3,921,424 | A | 11/1975 | Pearson | | |
| 4,038,853 | A * | 8/1977 | Schwarze | B21D 7/024 | 72/157 |
| 4,546,632 | A | 10/1985 | Van Den Kieboom | | |
| 4,625,531 | A | 12/1986 | Lafrasse et al. | | |
| 5,499,521 | A * | 3/1996 | Luikart | B21D 7/024 | 72/149 |
| 6,079,246 | A * | 6/2000 | Caporusso | B21D 7/024 | 72/157 |
| 6,434,993 | B1 | 8/2002 | Broggi et al. | | |
| 7,100,414 | B1 * | 9/2006 | Briggs | B21D 7/02 | 72/149 |
| 7,293,444 | B2 * | 11/2007 | Hacker | B21D 7/024 | 72/157 |
| 7,380,430 | B1 * | 6/2008 | Rusch | B21D 7/02 | 72/149 |
| 8,220,304 | B2 | 7/2012 | Etienne | | |
| 2010/0101299 | A1 * | 4/2010 | Caporusso | B21D 7/024 | 72/449 |
| 2010/0180653 | A1 * | 7/2010 | Wolf | B21D 7/024 | 72/156 |

FOREIGN PATENT DOCUMENTS

| | | | | |
|---|---|---|---|---|
| GB | 311720 A * | 5/1929 | | B21D 7/024 |
| WO | WO 2004091851 A1 * | 10/2004 | | B23Q 3/06 |

* cited by examiner

DIE AND COUNTER-DIE TYPE BENDING MACHINE FOR RIGHT-HAND AND LEFT-HAND BENDING AN ELONGATED PIECE

TECHNICAL FIELD OF THE INVENTION

The present invention relates to a die and counter-die type bending machine for right-hand and left-hand bending an elongated piece.

BACKGROUND OF THE INVENTION

Bending machines that are able to right-hand and left-hand bend elongated workpieces such as pipes are already present on the market. A bending machine by BLM S.p.A., Cantù, Italy, owner of U.S. Pat. No. 6,434,993, can be cited among the others. Said patent discloses a bending machine having a bed with body and head portions, a pair of longitudinal guides on the body portion, a pair of transverse guides on the head portion, a body carriage for holding the workpiece and being mounted on the longitudinal guides, a head carriage mounted on the transverse guides, a workpiece bending assembly mounted on the head carriage and including an elongated shaft, a pair of bending dies at opposite end regions of the shaft, and a pair of bending arms each operative for bending the workpiece against a respective bending die, and a drive for turning the bending assembly about a turning axis parallel to the longitudinal axis to position a selected one of the bending dies against the workpiece to be bent, the turning drive being mounted movable along the transverse axis with the head carriage. The machine according to the above-mentioned patent, which allows, among other, any desired both right- and left-hand bending operation, is very complex.

There are also bending machines simpler than that mentioned above which allow right and left curves to be made. Examples of such machines are described in U.S. Pat. No. 2,455,138, EP-0 168 331 and U.S. Pat. No. 8,220,304. These bending machines are of the type having a fixed die and a bend arm rotating around the fixed die.

The present invention aims instead to achieve a die and counter-die type bending machine. Therein, a roller-shaped die being provided with a partial circumferential groove that is interrupted at its two ends, is driven by the shaft of a motor, and a counter-die is carried by a counter-die support member pivoted on a turret mounted on a slide which is adapted to engage the counter-die with the die. In this type of bending machine, a bending in one direction and in the opposite one can be performed by turning upside down the die and the counter-die. This operation is easy when die and counter-die are of small size, and it becomes hard and difficult if they are of large dimensions and then heavy.

A main purpose of the present invention is to provide a die and counter-die type bending machine by which an operator can change the direction of curvature, without turning upside down the die and the counter-die.

Another object of the present invention is to provide a die and counter-die type bending machine by which an operator can select and perform the curvature in one direction, and proceed with ease in the opposite direction by discharging the piece to be bent and recharging it on the same bending machine.

Still another object of the present invention is to provide a die and counter-die type bending machine by which an operator can select and perform the curvature in one direction, and proceed with ease to the curvature in the opposite direction even without discharging the piece to be bent, by virtue of a suitable choice of retaining means and the counter-die supporting turret.

These objects are achieved by a die and counter-die type bending machine in which at least one retaining means for retaining a piece to be bent is provided on the die, and a double counter-die, for right- and left-hand bending respectively is provided.

Although die and counter-die type bending machines equipped with a pair of pipe retaining means on the die already exist, they only serve to bend pipes of different diameter. See for example U.S. Pat. No. 3,921,424, U.S. Pat. No. 4,546,632 and U.S. Pat. No. 5,499,521.

U.S. Pat. No. 3,921,424 discloses a portable pipe bending comprising two matrices together in a single piece, each being equipped with a pipe retaining means. The pipe retaining means is hooks of different size provided at their end with corresponding grooves for retaining a pipe having a first diameter and a second diameter respectively. In order to change a pipe of a second diameter after having bent a pipe of a first diameter, the die needs to be turned upside down and the pipe to be attached to its retaining means. The operation for bending each pipe of different diameter occurs by clockwise rotating the die, and the discharge of the pipe is achieved by counterclockwise rotating the die. The counter-dies consist of a pair of rollers mounted on a single pivot shaft adapted to be suitably positioned depending on the diameter of the pipe to be bent.

U.S. Pat. No. 4,546,632 discloses a portable electric bender able to receive pipes of various sizes in a cone-shaped rotatable die. The die has a pair of diametrically opposite die portions, and each die portion has a plurality of curvature grooves equipped with retaining elements for retaining a pipe of different diameter. There is a similar assembly of rollers acting as a counter-die.

U.S. Pat. No. 5,499,521 discloses a bender provided with a die having a plurality of concave grooves in its outer surface. The die is provided, in a diametrically symmetrical position, with a space adapted to receive a different retaining means depending on the pipe to be retained. A pair of rollers mounted on a frame in a swinging way act as a counter-die.

Shortly, all the above mentioned three benders are intended to bend only in one direction, namely to right hand, pipes of different diameter and, in the case of U.S. Pat. No. 4,546,632, also according to curves of different radius.

SUMMARY OF THE INVENTION

The present invention provides a die and counter-die type bending machine for right-hand and left-hand bending an elongated piece, comprising a roller-shaped die provided with a partial circumferential groove that is interrupted at its two ends, the die being driven by the shaft of a motor, and a first counter-die carried by a first counter-die support member pivoted on a turret mounted on a slide which is operated to move the counter-die with the respect to the die. The first counter-die support member and the turret have axes parallel to each other.

The die according to the present invention has an elongated piece retaining means. A second counter-die is carried by a second counter-die support member pivoted on the turret along an axis parallel to the axis of the turret, which, in turn, is rotatably mounted by a lever in a given arc of rotation about its axis perpendicular to the slide.

The first or the second counter-die are selectable to co-operate with the die in bending said elongated piece depending on the required curvature to the right hand or the left hand of the same.

DETAILED DESCRIPTION OF THE INVENTION

The object and advantages of the present invention will become more apparent from the drawings and the following description. variations and modifications of the embodiments shown and described can be substituted without departing from the principles of the invention, as will be evident to those skilled in the art.

Figure 1:
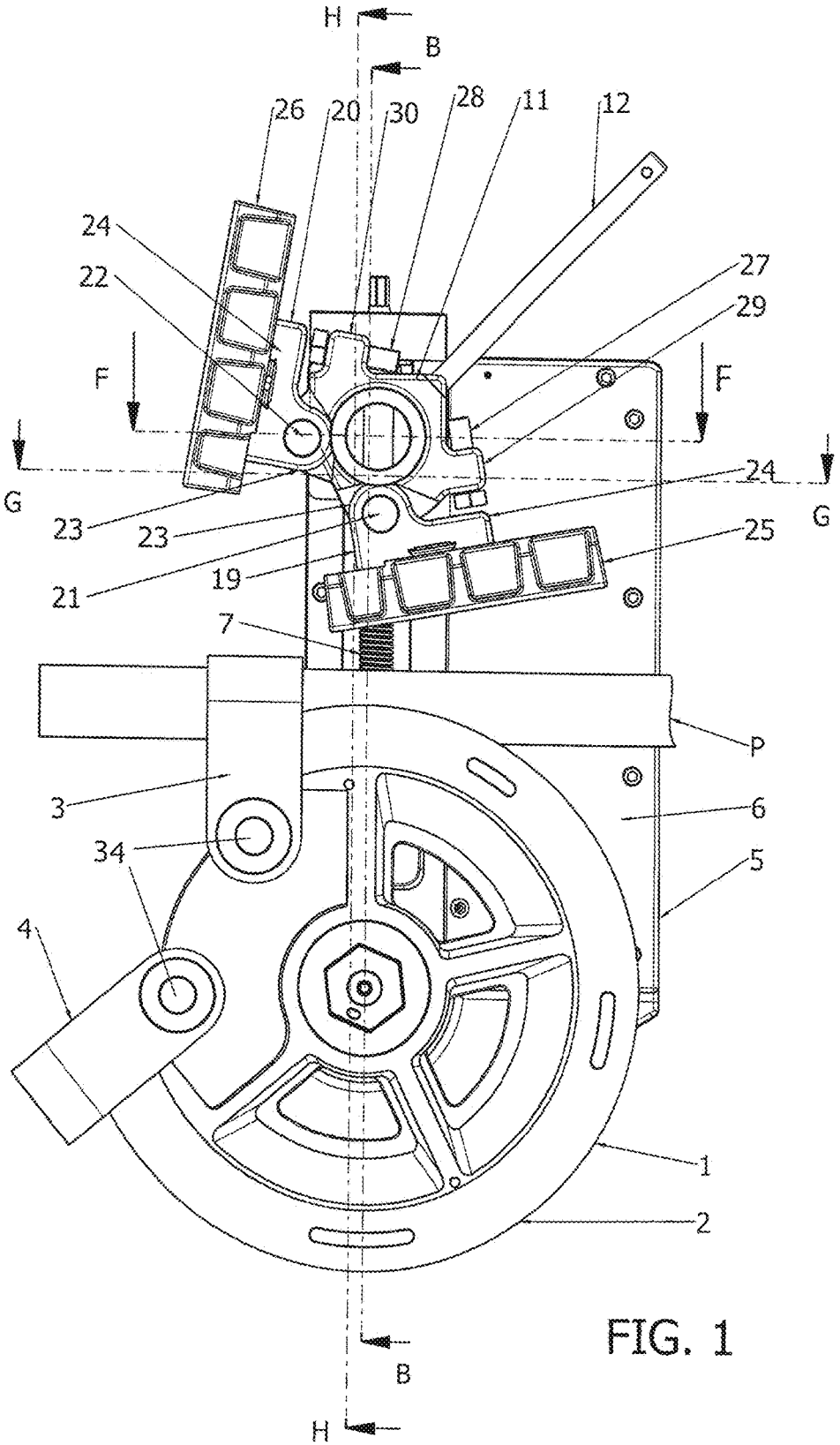
FIG. 1 is a top plan view of the bending machine according to the present invention in an initial phase of the counterclockwise bending operation, i.e. to left-hand.
Figure 5:
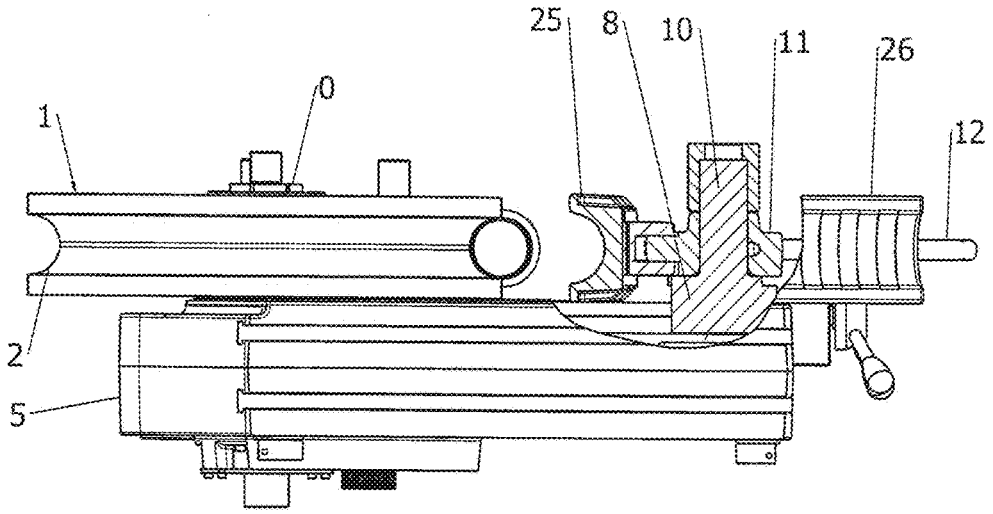
FIG. 5 is an enlarged side view of the bending machine shown in FIG. 1, a partial cross-section of the same being made along lines H-H.

First, reference is made to FIG. 1, which shows a top plan view of the bending machine according to the present invention in an initial phase of the bending operation. As above mentioned, the bending machine is of the die and counter-die type. It comprises a roller-shaped die 1 provided with a partial circumferential groove 2, best shown in FIG. 2 that is a side view being partially sectioned along the lines B-B in the top view of FIG. 1. The partial circumferential groove 2 is interrupted at its two ends, where respective retaining means 3, 4 is provided. Such retaining means 3, 4, as known, has substantially a U-shape, the sides of the U-shape being joined at free ends thereof by a pivot 34 passing through the die 1. The die 1 is driven by a shaft 0 of a motor not shown in the Fig.s. A casing 5 of the same bending machine is partially shown only in its upper part 6. Made on the upper part 6 of the casing 5 is a guide 7 suitable for sliding a slide 8 better shown in the side views of FIGS. 3 and 5, which are partially cross-sectioned according to the lines F-F and H-H in FIG. 1, as well as in FIG. 9 which is an exploded perspective view of a counter-die support member.

Figure 6:
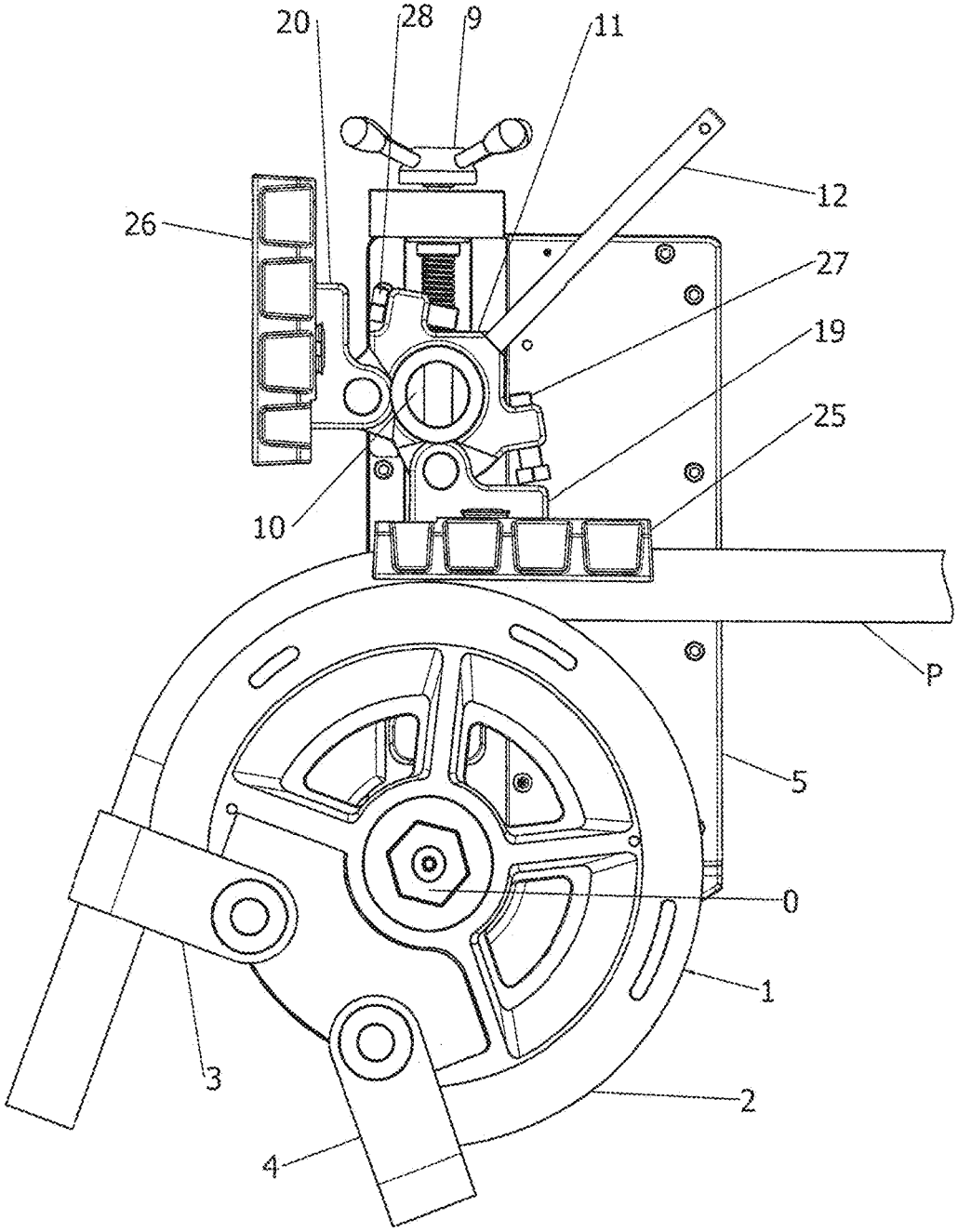
FIG. 6 is a top plan view of the bending machine in FIG. 1 in a final moment of a counter-clockwise bending operation, i.e. to left-hand.
Figure 7:
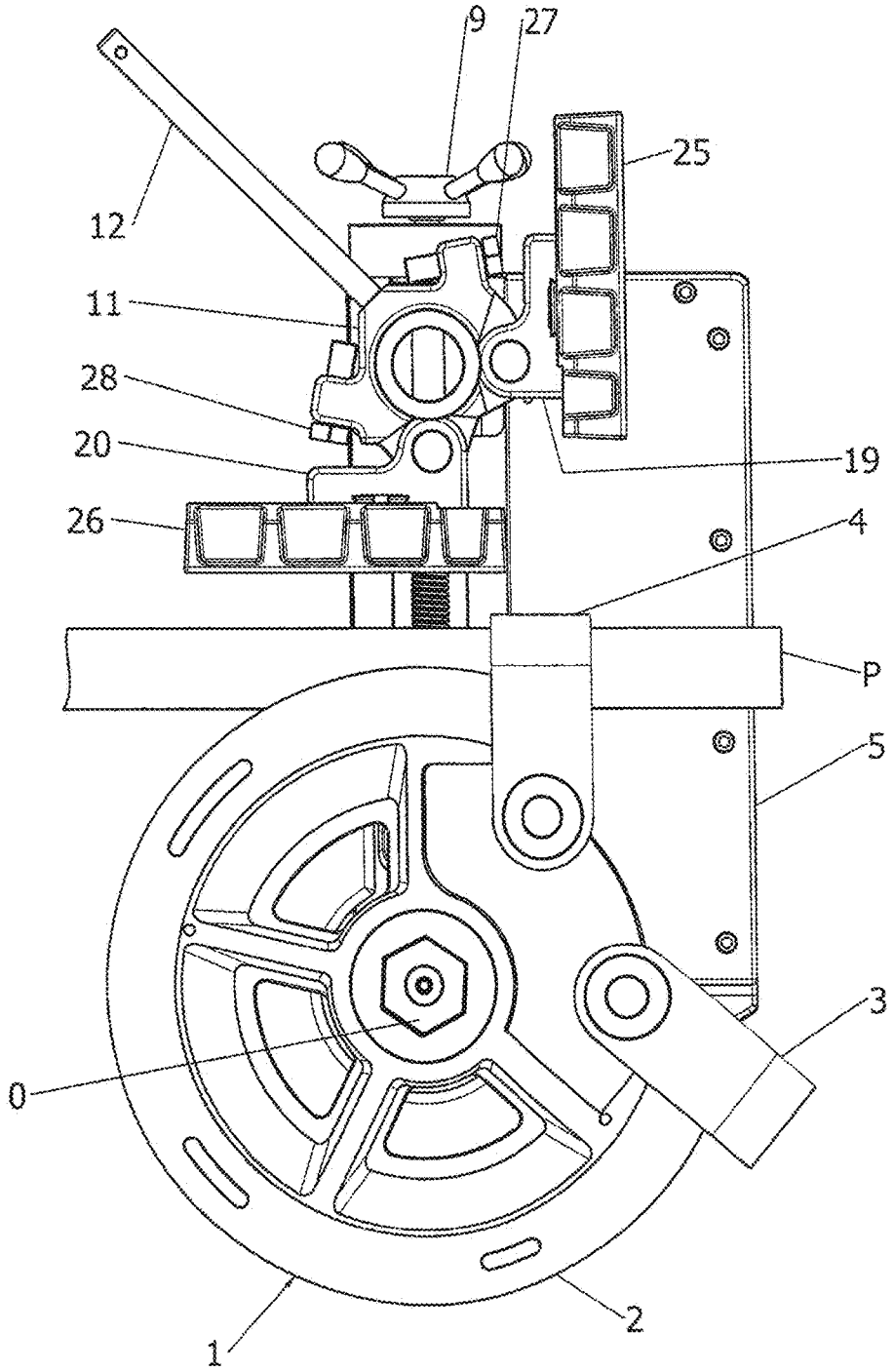
FIGS. 7 and 8 are top plan views of the bending machine in FIG. 1 in initial and final moments of a clockwise bending operation, i.e. to right-hand.
Figure 8:
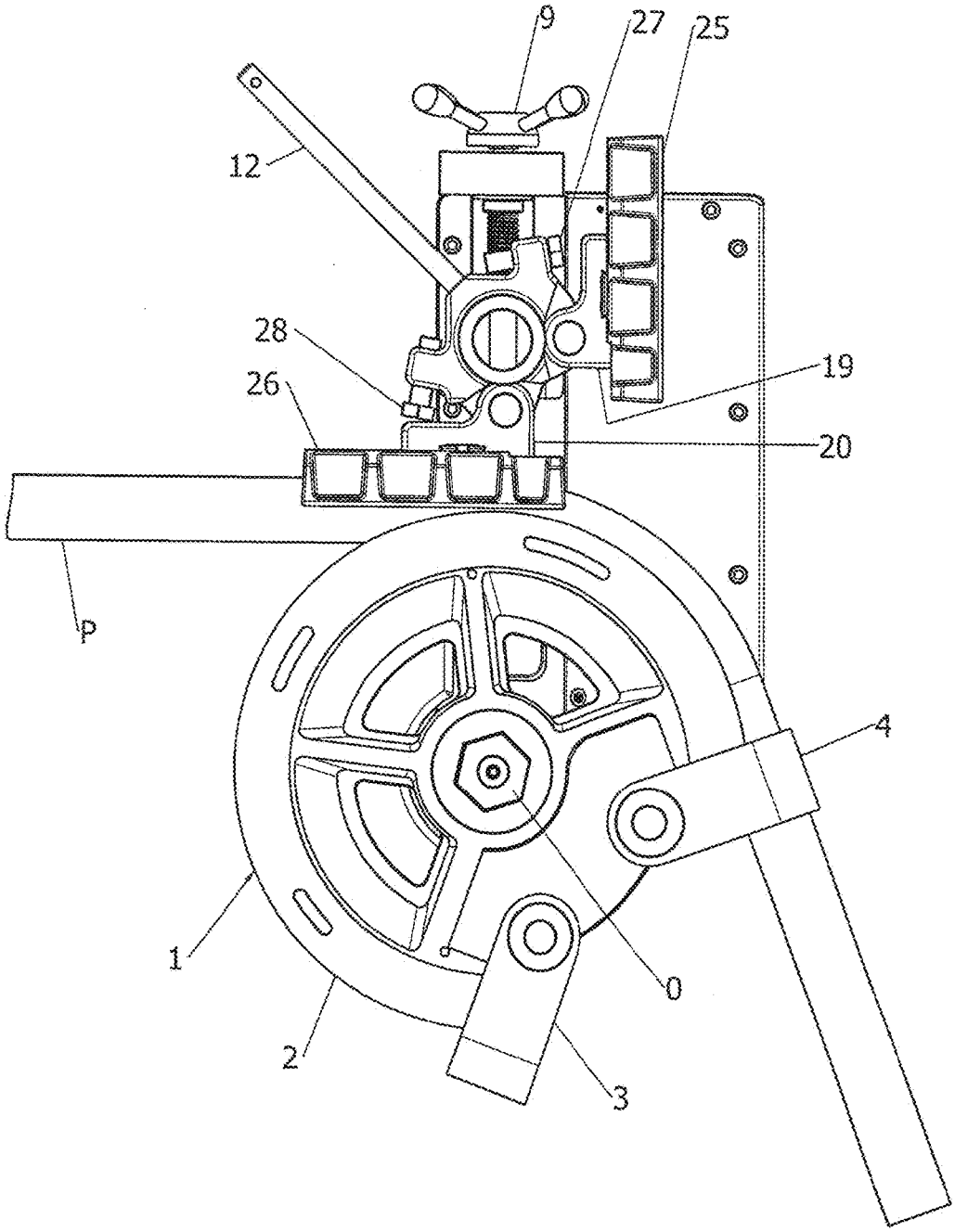

The slide 8 advances by means of a screw/nut screw coupling that is actuated by a handwheel 9 as shown in FIGS. 1, 2, 3, 6, 7, and 8, FIGS. 1, 6 being top plan views of the bending machine in FIG. 1 in initial and final moments of a counterclockwise bending operation, i.e. to left-hand, and FIGS. 7 and 8 in initial and final moments in a clockwise bending operation, i.e. to right-hand.

Figure 2:
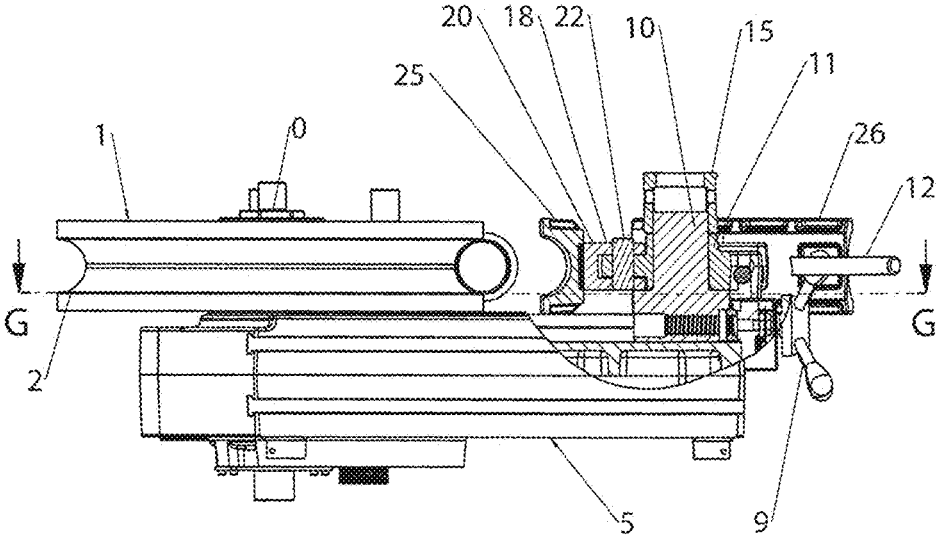
FIG. 2 is an enlarged side view of the bending machine shown in FIG. 1, a partial cross-section of the same being made along lines B-B.
Figure 3:
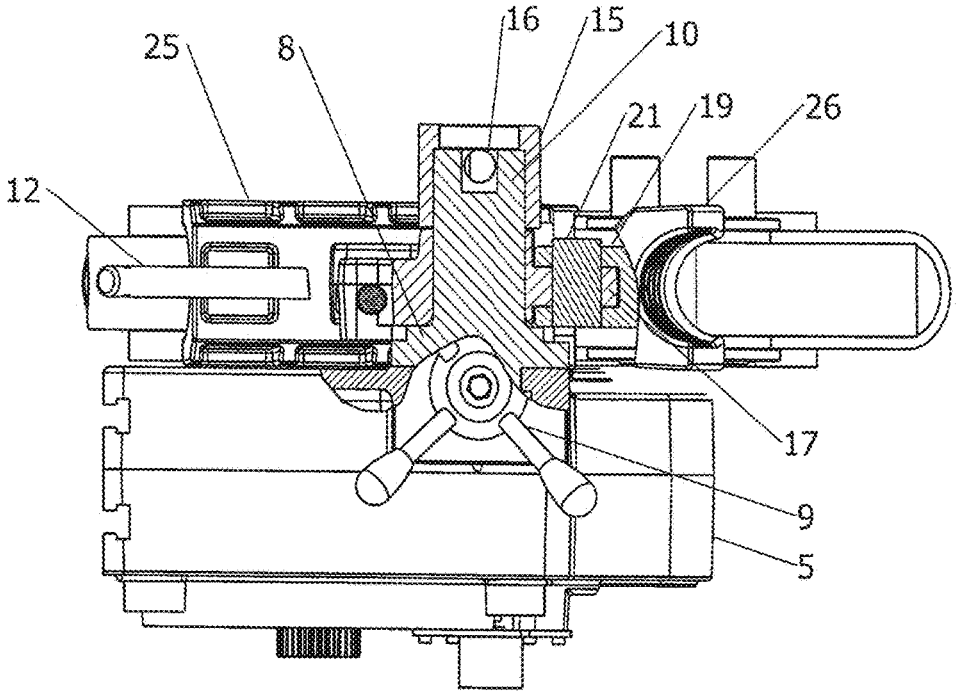
FIG. 3 is an enlarged side view of the bending machine shown in FIG. 1, a partial cross-section of the same being made along lines F-F.
Figure 4:
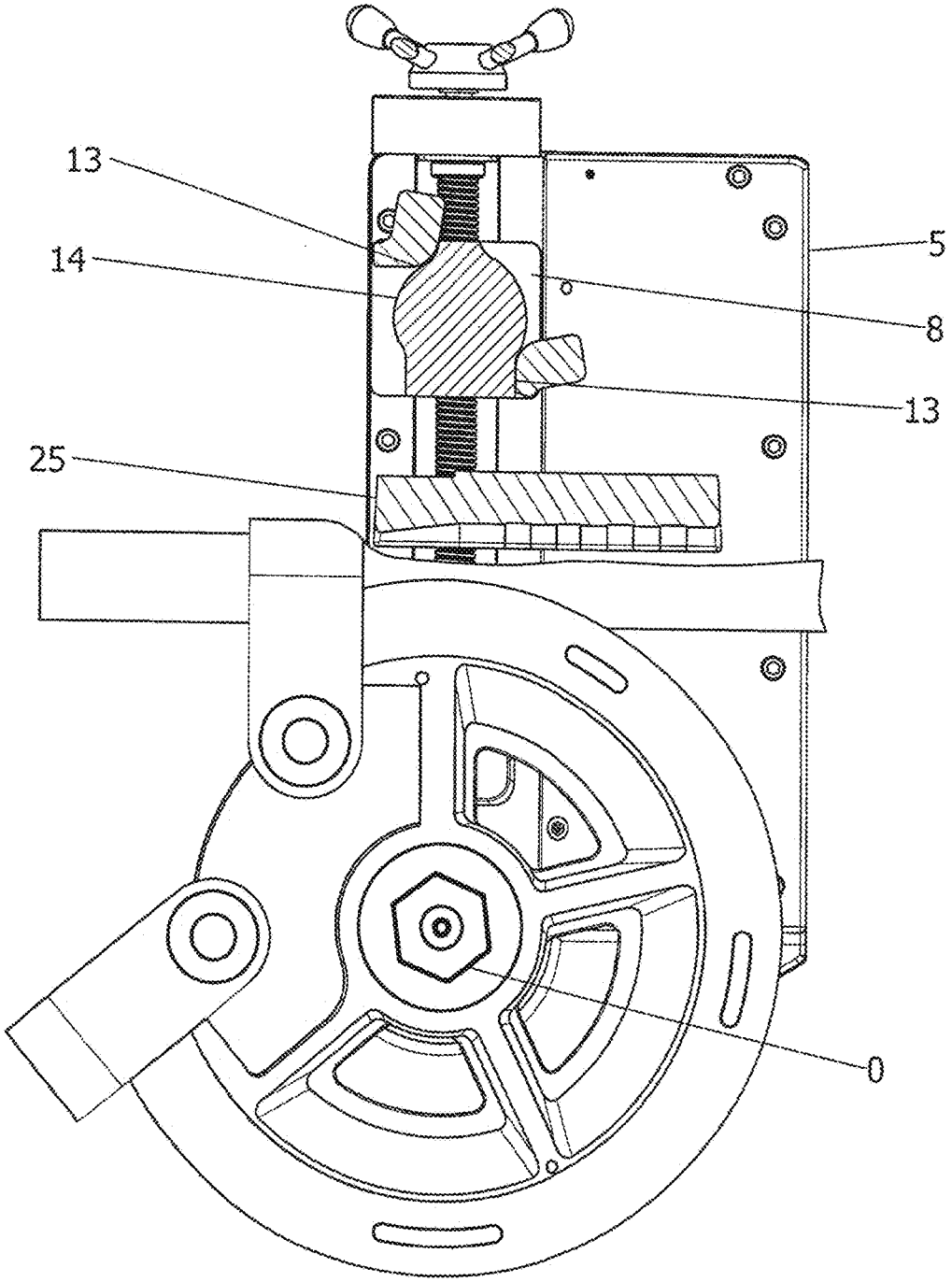
FIG. 4 is an enlarged view of the bending machine shown in FIG. 2, a partial cross-section of the same being made along lines G-G.
Figure 9:
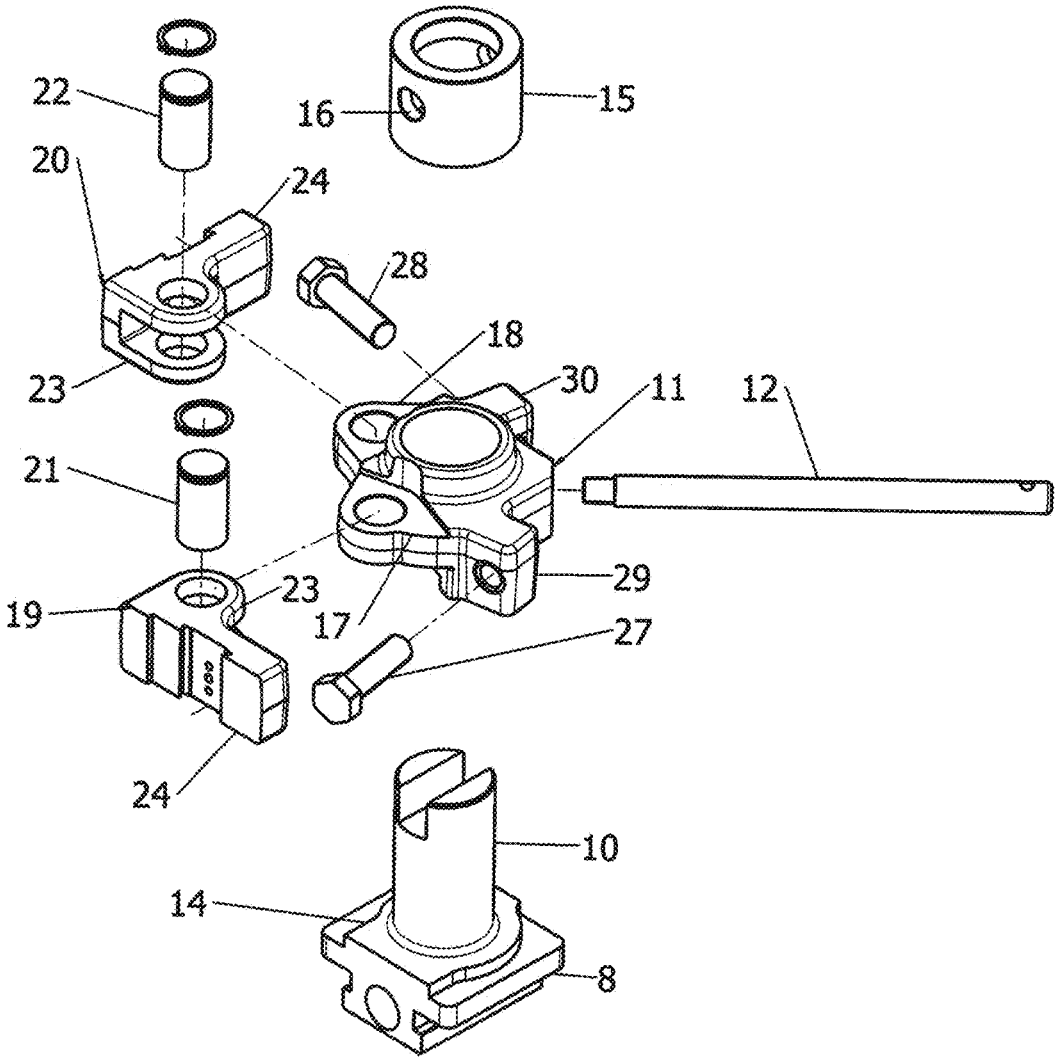
FIG. 9 is an exploded perspective view of a counter-die support member of the bending machine according to the present invention.

The slide 8 extends upwards in a columnar element 10 best shown in FIGS. 2, 3, 5, and 9. Concentrically sleeve mounted to the columnar element 10 is a turret 11, that can rotate on the slide 8 if it is operated by a rod 12 connected to the turret 11. The turret 11, as shown in FIG. 4, has at the bottom a pair of abutment elements 13 co-operating with a similar pair of abutment elements 14 formed on the slide 8. In this way, the turret 11 can rotate in a given arc of rotation on the slide 8. The turret 11 is locked on the top in order to prevent its slippage from the columnar element 10 by an abutment ring 15 arranged for a diametrical pin passing through the hole 16, as shown in particular in FIGS. 3 and 9. The turret 11 has a pair of arms 17, 18 (FIGS. 3, 2, 9) on each of which a counter-die support member 19, 20 is pivotally mounted, each arm 17, 18 being connected to the respective counter-die support member 19, 20 by means of a pin denoted as 21 and 22 respectively (FIGS. 3, 2 and 9). The counter-die support members 19, 20 have an elongated shape.

Each counter-die support member 19, 20 has a protuberance 23 provided with a through hole for receiving the pins 21, 22, and a narrower portion 24 adapted to be connected to a counter-die 25 and 26, respectively, to support it.

The counter-die support members 19, 20 being pivoted on the turret 11 are rotatable in an arc limited by a respective counteracting adjustable element 27, 28 that is threadedly coupled with related bored protrusions 29, 30 of the turret 11.

Shown in FIG. 1 is an elongated piece P to be bent that is inserted in the groove 2 of the die 1 and retained by retaining means 3 in the die 1 itself.

The elongated piece P is ready to be counterclockwise bent, i.e. to left hand. The turret 11 is rotated to right hand by the rod 12 fully shown in FIG. 1, and a lower abutment element 13 thereof engages a corresponding abutment element 14 of the slide 8 (FIG. 4). The counteracting adjustable element 27 that limits the arc of rotation of the counter-die support member 19, is in general completely screwed in the bored protrusion 29 (FIG. 1). The slide 8 is approached to the die 1 by the handwheel 9 (FIG. 1). Then, the counter-die 25 is brought in contact with the elongated piece P. The bending machine begins to bend to left hand (FIG. 6). After a 20 degrees bending angle, one can observe that the counter-die support member 19 is rotated by a given angle (not shown in FIG. 6). At this point, the counteracting adjustable element is moved until it touches the counter-die support member 19. Also this operation is not shown in the drawings.

Once completed the curve to the left hand, the counter-die 25 is initially moved away from the die 1, by simply rotating the shaft 0 in a direction opposite to the bending direction, by a sufficient angle, for example 10 degrees or less. Later, the counter-die 25 is completely separated from the elongated piece P by rotating the turret 11 by the lever 12. At this point, by further rotating the shaft 0 to right hand, the die 1 is rotated in order to obtain the separation of the bent elongated piece P from the die 1.

In order to achieve a curve to right hand in the elongated piece P, as shown in FIG. 7, the elongated piece P to be bent is inserted in the groove 2 of the die 1 and retained in the retaining means of the die 1 itself.

The elongated piece P is ready to be clockwise bent, i.e. to right hand. The turret 11 is rotated by the rod 12 fully to left hand, and its lower abutment element is counterclockwise rotated to engage the corresponding abutment element of the slide. Now, the description of the adjustment of the counteracting adjustable element 28 is not repeated, being similar to that previously described.

The slide 8 is approached to the die 1 by the handwheel 9 (FIG. 7). The counter-die 26 is brought in contact with the elongated piece P. The bending machine begins to bend to right hand (FIG. 8). Once completed the curve to right hand, the counter-die 26 is moved away from the die 1, by simply rotating the shaft 0 in a direction opposite to the bending direction, by a sufficient angle, for example 10 degrees or less, as already described for bending the elongated piece P to left hand. Later, the counter-die 26 is completely separated from the elongated P by rotating the turret 11 by the lever 12. At this point, by further rotating the shaft 0 to left hand, the die 1 is rotated in order to obtain the separation of the bent elongated piece P from the die 1. Both right- and left-hand bending operations can be performed while maintaining the same position of the slide 8, and by rotating the turret 11 in the respective positions determined by the double pair of abutment elements 13 and 14. Advantageously, the die 1 remains mounted to the shaft 0 that is rotated to its initial positions shown in FIGS. 1 and 7.

From foregoing it is clear that the bending machine according to the invention allows the bending direction of an elongated piece P to be reversed simply and quickly, without the necessity of a removal of the die or any modification of the bending machine.

Figure 10:
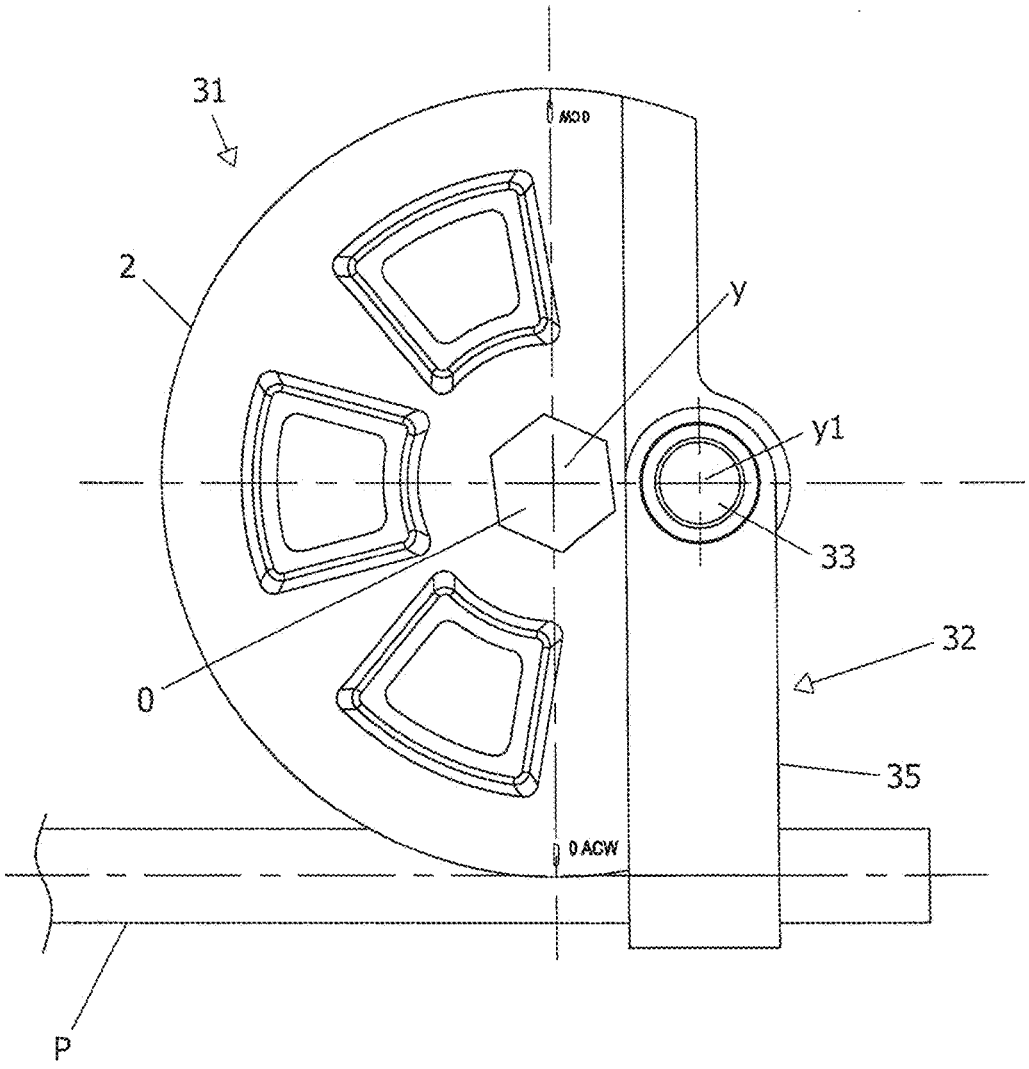
FIG. 10 is a top plan view of a variant of the die with respect to that shown in the bending machine of the previous figures, in which an elongate piece at the beginning of a counterclockwise bending phase, i.e. to left-hand, is engaged.

Reference is made now to FIG. 10, which is a top plan view of a variant of the die indicated as 31, which is different from that shown in the bending machine of the previous FIGS. 1 to 9. The rest of the bending machine is not represented as it is identical to that represented in those figures.

As shown in FIG. 10, an elongated element P is engaged to the die 31 at the beginning of a counterclockwise bending phase, i.e. to left hand.

The die 31 has only one retaining means 32 for locking the elongated piece P in the vicinity of each of the two ends of the partial circumferential groove 2 of the die 1.

Figure 11:
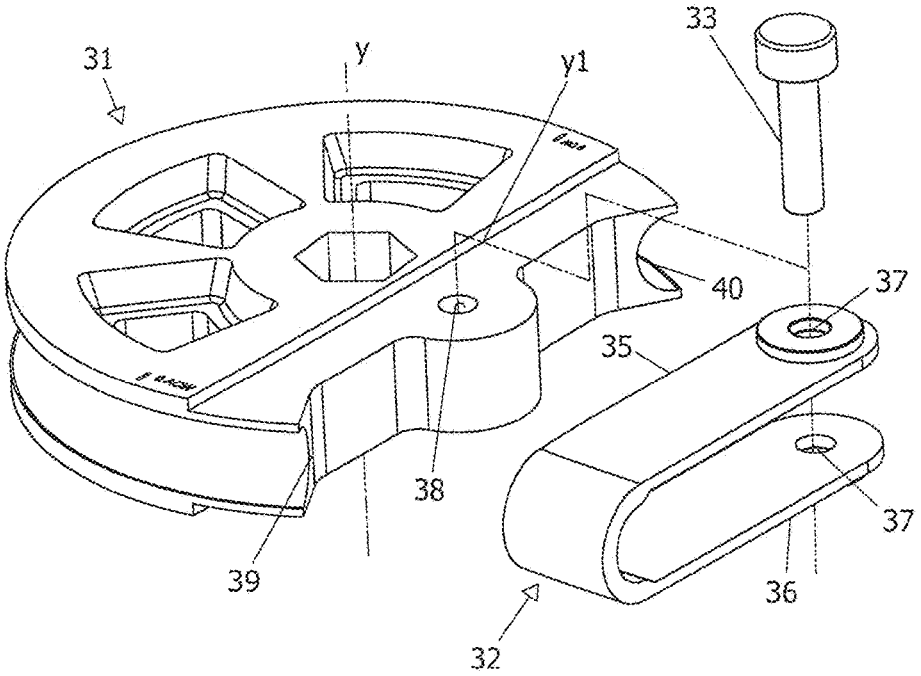
FIG. 11 is an exploded perspective view of the variant of the die in FIG. 10.

The retaining means 32 is U-shaped, as best seen in FIG. 11, which is an exploded perspective view of the variant of die in FIG. 10.

The retaining means 32 has sides 35, 36 that are provided in the vicinity of their free ends of through holes 37, 37, through which a pivot 33 can be inserted.

The die 31 is provided with a hole 38 having an axis y1 parallel to the axis y of the shaft 0 of the motor. The axis y1 of the hole 38 in the die 31 is equidistant between the two ends of the partial circumferential groove 2 of the die 31, which are indicated as 39, 40 in FIG. 11.

Figure 12:
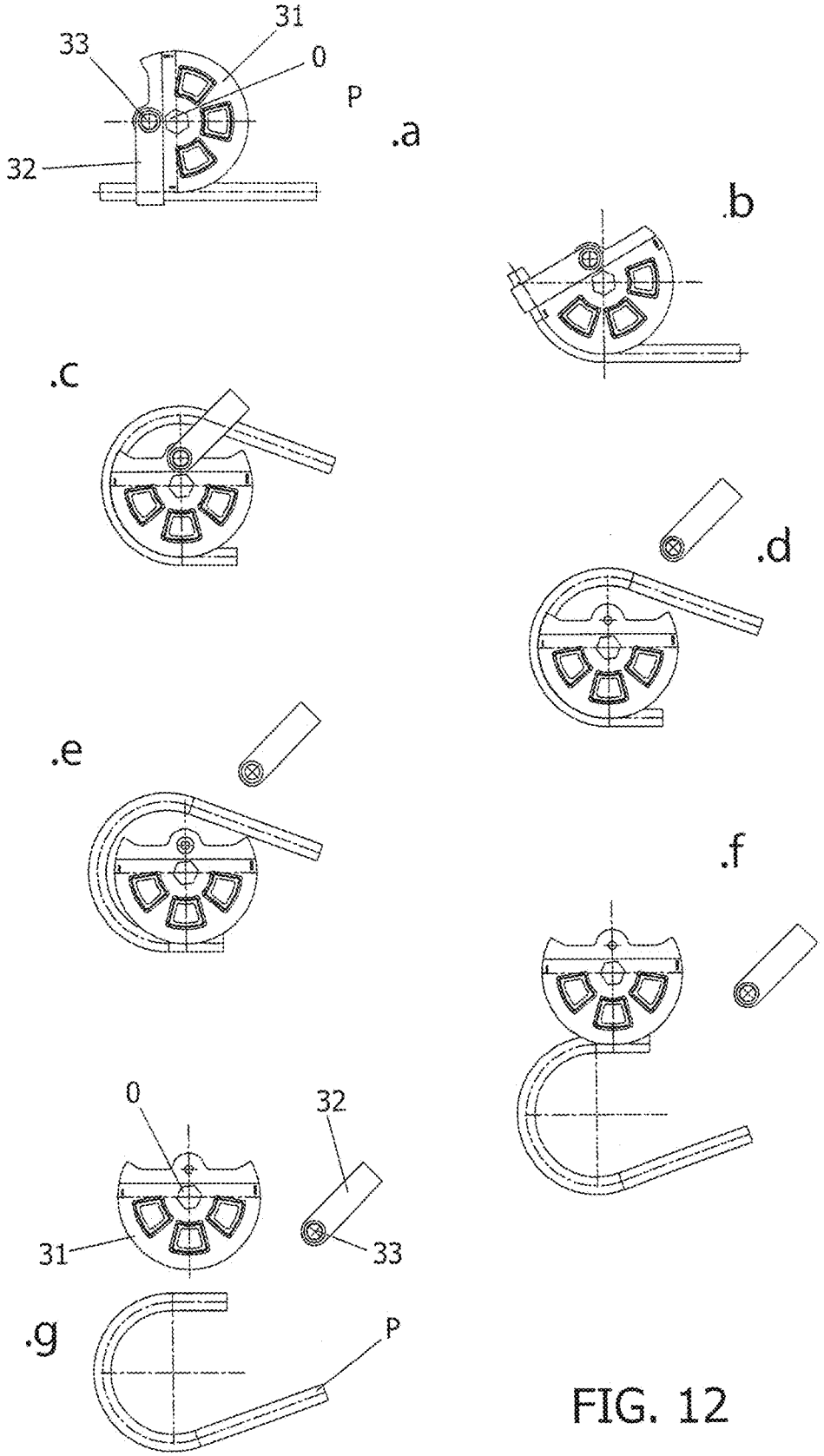
FIGS. 12.*a*-12.*g* are a plurality of top plan views of the variant of the die in FIG. 10 in successive clockwise bending phases, i.e. to left-hand, of an elongated piece.

If the pivot 33 is inserted coaxially in the first hole 37 on the side 35 of the retaining means 32, in the hole 38 of the die 31 and in the second hole on the side 36 of the retaining means 32, the retaining means 32 is able to retain the elongated piece P for both counterclockwise bending the elongated piece P, as shown in FIG. 10, and clockwise bending it as shown in FIGS. 12.*a*-12.*g*, which are a plurality of top plan views of the variant of die in FIG. 10 in successive phases of clockwise bending an elongated piece, i.e. to right-hand.

FIGS. 12.*a*-12.*g* clearly show that a die 31 being provided with only one retaining means 32 of the elongated piece P allows its curvature by an angle greater than 180 degrees with an easy extraction of the elongated piece P at the end of the operation. In particular, a view similar to that of FIG. 10 is shown in FIG. 12.*a*, but for clockwise bending. A first bending phase is shown in FIG. 12.*b*, and, as shown in FIG. 12.*c*, a curvature of more than 180 degrees is obtained. As shown in FIG. 12.*d*, the retaining means 32 is extracted from the die 31; in FIG. 12.*e*-12.*g* the bent elongated piece P is separated from the groove, turned upside down and removed from the die 31. This series of steps is valid also for the die having two retaining means, as previous described and illustrated in FIGS. 1 to 9.

The die 31 as a variant of the die 1 is more economic in its manufacture and has a smaller number of pieces with respect to die 1.

What is claimed is:

1. A die and counter-die type bending machine for right-hand and left-hand bending an elongated piece, comprising:

a motor having a motor shaft, a roller-shaped die mounted concentrically to and driven by said motor shaft and provided with a partial circumferential groove, the roller-shaped die having a pivotable retainer for an elongated piece, the pivotable retainer being U-shaped and having sides with free ends joined by a pivot that passes through the roller-shaped die, a slide slidable along a direction at right angles to the axis of the motor shaft, a turret mounted on the slide and rotatable by a manual lever in a given arc of rotation about an axis parallel to the axis of the motor shaft, and a first and a second counter-die that are each provided with a respective first and second counter-die support member that are each pivoted on the turret about a respective pin having a longitudinal axis parallel to the axis of the motor shaft, the slide being operated to move the first and the second counter-dies with the respect to the roller-shaped die, wherein the pins on which the first and second counter-die support members are respectively pivoted on the turret are circumferentially spaced 90 degrees from each other, and said given arc of rotation of the turret is also 90 degrees, and wherein said given arc of rotation of the turret is limited by means of a double pair of co-operating abutment elements formed on the slide and on a lower part of the turret, respectively, the first pair of abutment elements serving for left-hand bending and the second pair of abutment elements serving for right-hand bending.

2. The bending machine according to claim 1, wherein the first and second counter-die support members both being pivoted on the turret are rotatable in an arc of rotation limited by a respective adjustable counteracting element that is connected to the turret with a threaded coupling.

3. The bending machine according to claim 1, comprising two of said retainer that are located at respective ends of the partial circumferential groove.

* * * * *